US007862210B2

(12) United States Patent
Zhang et al.

(10) Patent No.: US 7,862,210 B2
(45) Date of Patent: Jan. 4, 2011

(54) LED LAMP WITH HEAT SINK ASSEMBLY

(75) Inventors: Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 372 days.

(21) Appl. No.: 12/034,665

(22) Filed: Feb. 21, 2008

(65) Prior Publication Data

US 2009/0213592 A1 Aug. 27, 2009

(51) Int. Cl.
*F21V 29/00* (2006.01)
*F21S 4/00* (2006.01)

(52) U.S. Cl. ..... 362/294; 362/249.02; 362/373; 362/800

(58) Field of Classification Search ..... 362/249.02–249.06, 294, 373, 290, 342, 362/249.01, 800
See application file for complete search history.

(56) References Cited

U.S. PATENT DOCUMENTS 3,593,014 A * 7/1971 Vesely ..... 362/291
6,880,956 B2 * 4/2005 Zhang ..... 362/294
7,079,041 B2 * 7/2006 Fredericks et al. ..... 362/545
7,095,187 B2 * 8/2006 Young ..... 362/227
7,314,291 B2 1/2008 Tain et al.
7,581,856 B2 * 9/2009 Kang et al. ..... 362/373
7,604,380 B2 * 10/2009 Burton et al. ..... 362/294
7,753,560 B2 * 7/2010 Xu et al. ..... 362/294
2007/0159828 A1 * 7/2007 Wang ..... 362/294

FOREIGN PATENT DOCUMENTS

TW I263008 10/2006

* cited by examiner

*Primary Examiner*—Alan Cariaso
(74) *Attorney, Agent, or Firm*—Frank R. Niranjan

(57) ABSTRACT

An LED lamp includes a support, an envelope, a heat sink assembly and a plurality of LED modules. The envelope is coupled to the support. The heat sink assembly includes a first heat sink mounted on the envelope, a cylindrical second heat sink attached to a bottom surface of the first heat sink and positioned in the envelope, and a plurality of heat pipes. The LED modules are mounted on an outside wall of the second heat sink. The heat pipes have condensing portions embedded in the bottom surface of the first heat sink and evaporating portions sandwiched between the outside wall of the second heat sink and the LED modules.

17 Claims, 4 Drawing Sheets

LED LAMP WITH HEAT SINK ASSEMBLY

BACKGROUND OF THE INVENTION

1. Field of the Invention

The present invention relates to an LED lamp, and particularly to an LED lamp with a heat sink assembly having heat pipes for improving heat dissipation of the LED lamp.

2. Description of Related Art

An LED lamp is a type of solid-state lighting device that utilizes light-emitting diodes (LEDs) as a source of illumination. An LED is a device for converting electricity into light by using a theory that, if a current is made to flow in a forward direction through a junction region comprising two different types of semiconductor, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

An LED lamp generally has a limited space therein and requires a plurality of LEDs. Most of the LEDs are driven at the same time, which results in a quick rise in temperature of the LED lamp. Since the limited space in the LED lamp, the heat sink has a restricted heat dissipating area and is unable to remove heat from the LEDs effectively. Operation of the conventional LED lamps thus has a problem of instability because of the rapid buildup of heat.

Besides, since an illuminant angle of the light emitted by the LEDs is generally restricted in a narrow range and the LEDs are mounted on a flattened surface of the heat sink, light of the LED lamp is of unsatisfactory spatial distribution.

What is needed, therefore, is an LED lamp which can overcome the above-mentioned disadvantages.

SUMMARY OF THE INVENTION

An LED lamp includes a support, an envelope, a heat sink assembly and a plurality of LED modules. The envelope is coupled to the support. The heat sink assembly includes a first heat sink mounted on a top of the envelope, a cylindrical second heat sink attached to a bottom surface of the first heat sink and positioned in the envelope, and a plurality of heat pipes. The LED modules are mounted on an outside wall of the second heat sink. The heat pipes have condensing portions connected with the bottom surface of the first heat sink and evaporating portions sandwiched between the outside wall of the second heat sink and the LED modules.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
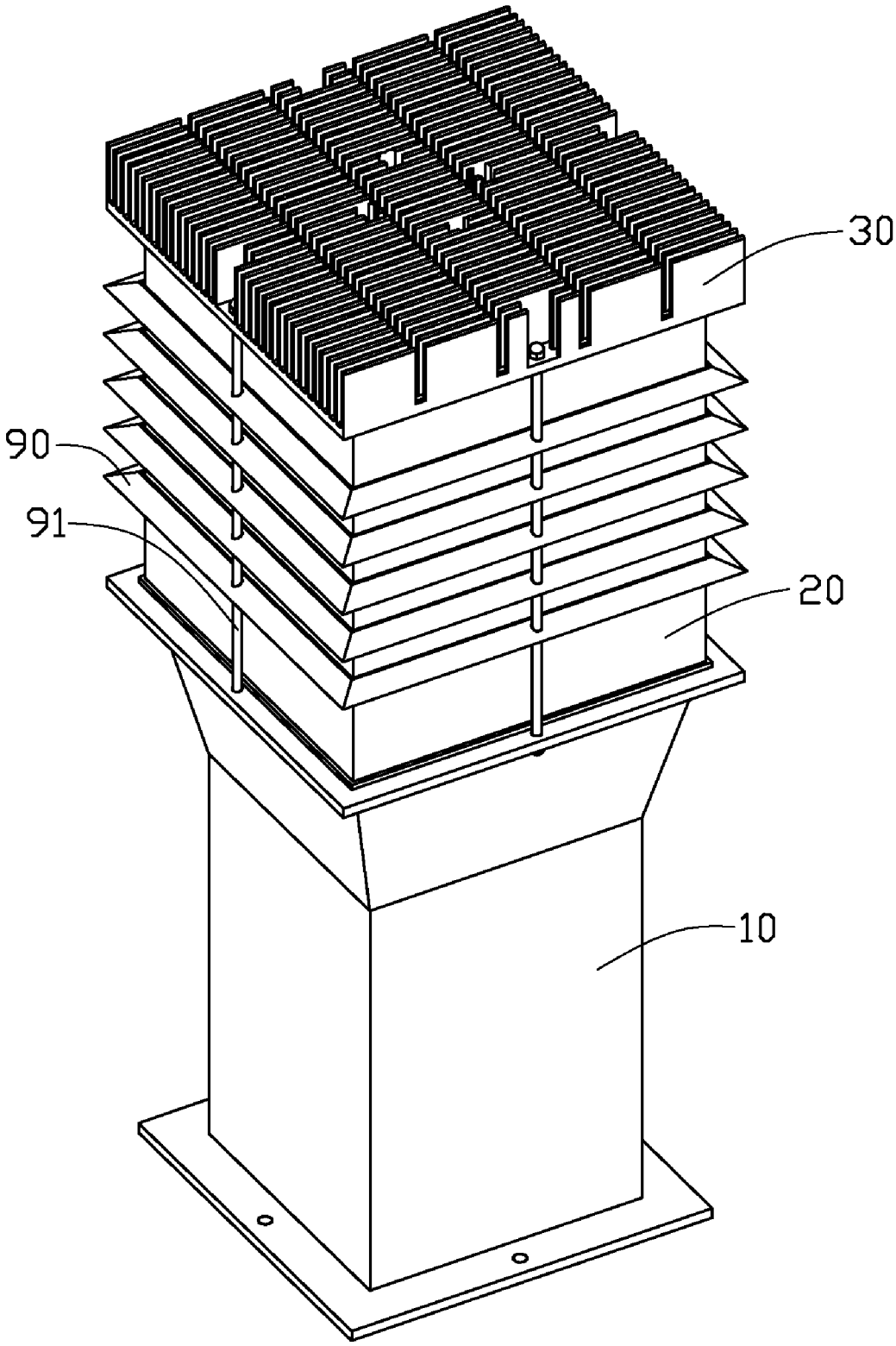
FIG. 1 is an isometric, assembled view of an LED lamp in accordance with a preferred embodiment of the present invention.
Figure 2:
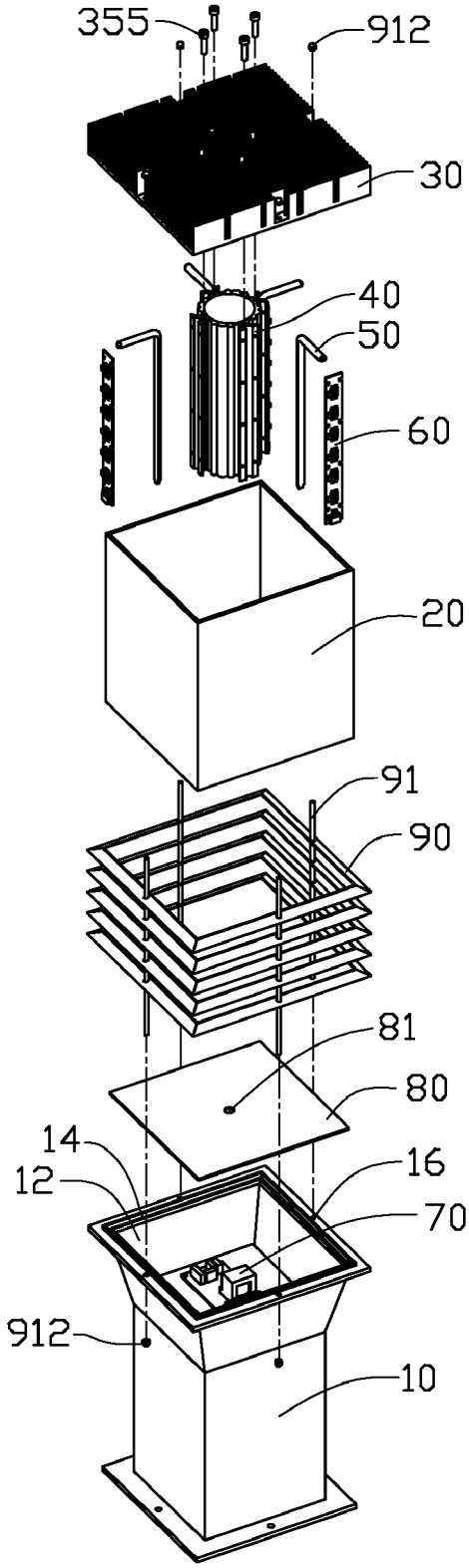
FIG. 2 is an isometric, exploded view of FIG. 1.

Referring to FIGS. 1-2, an LED lamp for a lighting purpose comprises a support 10, an envelope 20 coupled to a top of the support 10, a heat sink assembly (not labeled) and four LED modules 60 thermally attached to the heat sink assembly. The heat sink assembly comprises a first heat sink 30 located on a top of the envelope 20, a second heat sink 40 received in the envelope 20 and attached to a bottom surface of the first heat sink 30, and four heat pipes 50 thermally interconnecting the first and second heat sinks 30, 40. The four LED modules 60 are mounted around the second heat sink 40. A drive circuitry 70 is accommodated in the support 10 and electrically connected to the LED modules 60 to provide the LED modules 60 with electrical power, control signals, etc. A plurality of reflectors 90 are mounted surrounding the envelope 20.

The support 10 is substantially a square column. A bottom of the support 10 can be secured on an object such as the ground to install the LED lamp on the ground. A first receiving groove 14 is defined in a top of the support 10. The first groove 14 has a profile of a square ring. A first fixing hole 16 is defined in a middle portion of each of side edges of the top of the support 10. The first fixing holes 16 are positioned outside of the first receiving groove 14. A receiving space 12 is defined in an upper portion of the support 10. The drive circuitry 70 is accommodated in the space 12 of the support 10. A square plate 80 covers on the top of the support 10 for sheltering the drive circuitry 70. A center hole 81 is defined in the plate 80 for allowing lead wires (not shown) of the drive circuitry 70 to extend therethrough to connect with the LED modules 60.

The envelope 20 is substantially an elongated, square tube. A through opening is defined by four lateral walls of the envelope 20. A bottom edge of the lateral walls of the envelope 20 is received in the first receiving groove 14 of the support 10.

Figure 3:
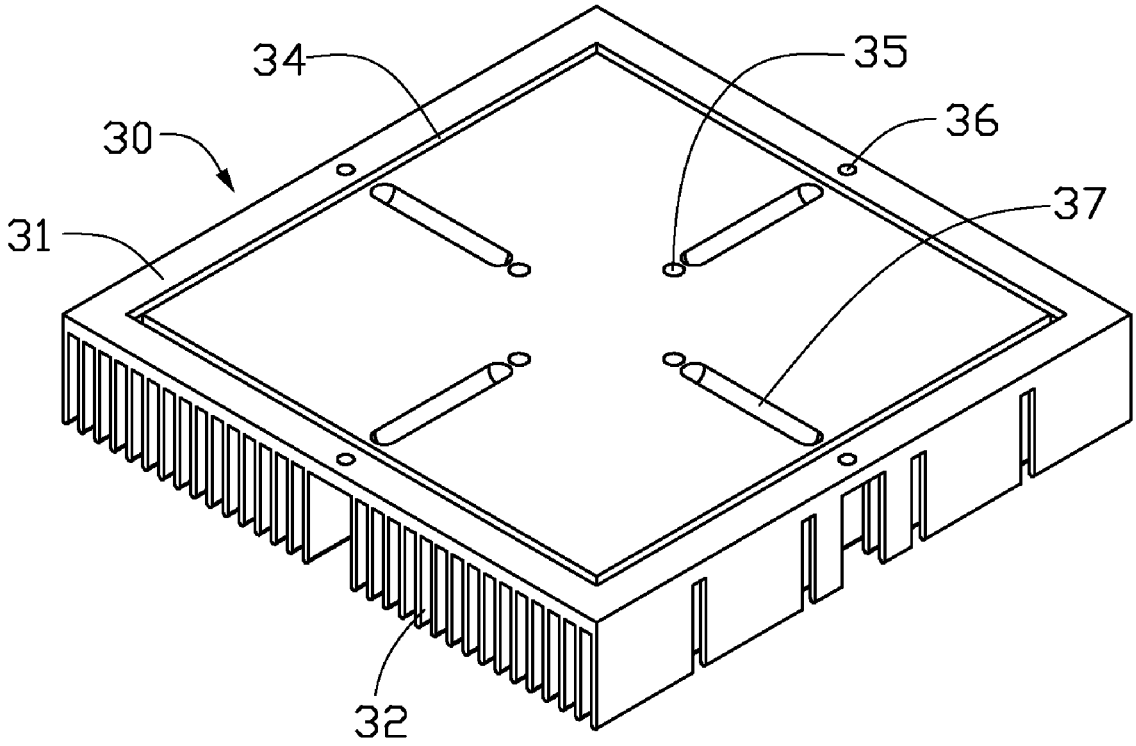
FIG. 3 is an enlarged view of a first heat sink of FIG. 2, but shown from another aspect.

Please also referring to FIG. 3, the first heat sink 30 comprises a square base 31 and a plurality of fins 32 extending upwardly from the base 31. A second receiving groove 34 is defined in a bottom surface of the base 31 for receiving a top edge of the lateral walls of the envelope 20 therein. Four through holes 35 are defined in the base 31, positioned within the second receiving groove 34 and centrosymmetric to a center of the base 31. A second fixing hole 36 is defined in a middle portion of each of side edges of the base 31. The second fixing holes 36 are positioned out of the second receiving groove 34. Four linear first receiving slots 37, in which portions of the heat pipes 50 are received, are defined in the bottom surface of the base 31. Each first receiving slot 37 is positioned inside of the second receiving groove 34. The first receiving slots 37 are arrayed radially outwardly from the center of the base 31 and each of the first receiving slots 37 is located between a corresponding through hole 35 and a corresponding second fixing hole 36.

Figure 4:
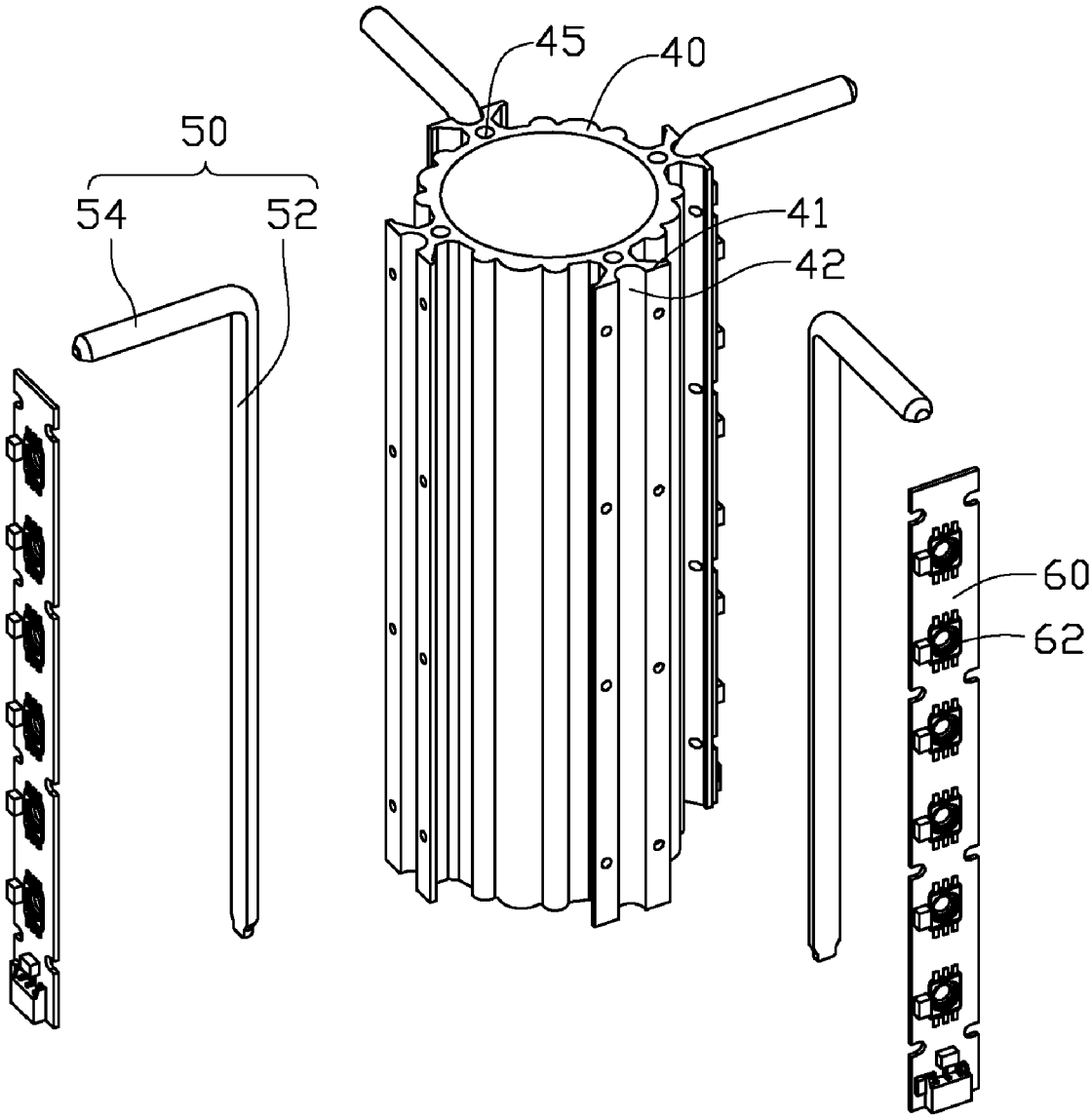
FIG. 4 is an enlarged view of a second heat sink cooperating with heat pipes and LED modules of FIG. 2.

Also referring to FIG. 4, the second heat sink 40 is substantially a cylindrical tube with a through hole (not labeled) defined in a center thereof. Corresponding to the through holes 35 in the base 31 of the first heat sink 30, four screw holes 45 are defined in a top end of the second heat sink 40. Screws 355 can extend through the through holes 35 and screw in the corresponding screw holes 45 for fixing the first heat sink 30 and second heat sink 40 together. Four ridges 41, on which the LED modules 60 are respectively mounted, evenly and outwardly extend from an outside wall of the second heat sink 40. Each ridge 41 is elongated along an axial direction of the second heat sink 40. A second receiving slot 42 is defined in each of the ridges 41 and extends from top to bottom of the second heat sink 40 for receiving a portion of a corresponding heat pipe 50 therein.

The heat pipes 50 each have an identical configuration. Each of the heat pipes 50 is L-shaped and comprises an evaporating portion 52 received in a corresponding second receiving slot 42 of the second heat sink 40 and a condensing portion 54 received in a corresponding first receiving slot 37 of the first heat sink 30.

Each of the LED modules 60 comprises an elongated printed circuit board (not labeled) and a plurality of LEDs 62 mounted on the printed circuit board. The LEDs 62 are arrayed in a line along a length of each LED module 60.

Each of the reflectors 90 is substantially a squarely ring-shaped frame consisting of four flaps (not labeled) which are slantwise downwardly and outwardly toward the support 10. A bottom surface of each of the flaps can reflect light emitted by the LED modules 60 downwardly to the support 10. Four posts 91 respectively extend through the flaps of the reflectors 90 for fixing the reflectors 90 together to the LED lamp at a position around the envelope 20 and between the support 10 and the first heat sink 30. Bottom ends of the posts 91 extend through the first fixing holes 16 of the support 10. Top ends of the posts 91 extend through the second fixing holes 36 of the first heat sink 30. A plurality of nuts 912 can screw in the bottom and top ends of the posts 91 for securing the first heat sink 30, the envelope 20, the support 10 and the reflectors 90 together.

In assembly of the LED lamp, the drive circuitry 70 is accommodated in the space 12 of the support 10, and the plate 80 covers on the top of the support 10. The envelope 20, surrounded with the reflectors 90, is coupled to the support 10. The second heat sink 40 is attached to the bottom surface of the first heat sink 30, and the heat pipes 50 are adhered to the first and second heat sinks 30, 40. The LED modules 60 are mounted on the ridges 41 of the second heat sink 40. Then the first heat sink 30 of the heat sink assembly is coupled on the top of the envelope 20, with the top of the envelope 20 fittingly received in the second receiving groove 34, and the second heat sink 40 and the heat pipes 50 of the heat sink assembly and the LED modules 60 accommodated in the envelope 20. In this embodiment, the numbers of the ridges 41 of the second heat sink 40, the heat pipes 50 and the LED modules 60 are all four. Understandably, the numbers of these elements can be different in different embodiments.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a support defining a receiving space therein;

an envelope coupled to the support;

a first heat sink mounted on the envelope and comprising a plurality of fins;

a cylindrical second heat sink received in the envelope and attached to a bottom surface of the first heat sink;

a plurality of LED modules mounted on an outside wall of the second heat sink;

a plurality of L-shaped heat pipes having vertical evaporating portions sandwiched between the LED modules and the outside wall of the second heat sink and parallel to an axial direction of the second heat sink, and horizontal condensing portions received in a plurality of slots defined in the bottom surface of the first heat sink; and a drive circuitry accommodated in the space of the support and electrically connected with the LED modules.

2. The LED lamp as claimed in claim 1, wherein a receiving groove is defined in the bottom surface of the first heat sink for receiving a top end of the envelope, and a receiving groove is defined in the support for receiving a bottom end of the envelope.

3. The LED lamp as claimed in claim 1, wherein a plurality of ridges extends from the outside wall on which the LED modules are mounted, a slot is defined in each of the ridges for receiving a corresponding evaporating portion of one of the heat pipes therein.

4. The LED lamp as claimed in claim 1, wherein a plurality of screw holes are defined in a top of the second heat sink, and corresponding to the screw holes, a plurality of through holes is defined in the first heat sink for screws extending therethrough to threadedly engage in the screw holes for securing the first heat sink and the second heat sink together.

5. The LED lamp as claimed in claim 1, wherein a plate covers on the support for sheltering the drive circuitry.

6. The LED lamp as claimed in claim 1, wherein a plurality of reflectors surrounds the envelope, and a plurality of posts extends through the reflectors for fixing the reflectors together.

7. The LED lamp as claimed in claim 6, wherein each of the posts has a top end connected with the first heat sink and a bottom end connected with the support.

8. An LED lamp, comprising:

a support;

an envelope coupled to the support;

a heat sink assembly comprising a first heat sink mounted on the envelope, a cylindrical second heat sink attached to a bottom surface of the first heat sink and positioned in the envelope and a plurality of L-shaped heat pipes having horizontal condensing portions received in a plurality of slots defined in the bottom surface of the first heat sink and vertical evaporating portions; and a plurality of LED modules mounted on an outside wall of the second heat sink;

wherein the evaporating portions of the heat pipes are sandwiched between the LED modules and the outside wall of the second heat sink.

9. The heat sink as claimed in claim 8, further comprising a drive circuitry received in the support and electrically connected with the LED modules.

10. The heat sink as claimed in claim 9, wherein a plate covers on the support for sheltering the drive circuitry, and a center hole is defined in the plate adapted for lead wires of the drive circuitry extending therethrough to electrically connect with the LED modules.

11. The heat sink as claimed in claim 8, wherein a receiving groove is defined in the bottom surface of the first heat sink for receiving a top end of the envelope, and a receiving groove is defined in the support for receiving a bottom end of the envelope.

12. The LED lamp as claimed in claim 8, wherein a plurality of ridges extends from the outside wall on which the LED modules are mounted, a slot is defined in each of the ridges for receiving a corresponding evaporating portion of one of the heat pipes therein.

13. The LED lamp as claimed in claim 8, wherein a plurality of reflectors surrounds the envelope, and a plurality of posts extends through the reflectors for fixing the reflectors together, with two ends there of each of the posts connecting with the first heat sink and the support, respectively.

14. An LED lamp comprising:

a support;

an envelope mounted on a top of the support;

a first heat sink mounted on a top of the envelope;

a cylindrical second heat sink secured to a bottom of the first heat sink and received in the envelope;

a plurality of LED modules mounted to an outer periphery of the second heat sink; and a plurality of L-shaped heat pipes each having a horizontal condensing portion embedded in the bottom of the first heat sink and a vertical evaporating portion sandwiched between the outer periphery of the second heat sink and a corresponding LED module and parallel to an axial direction of the second heat sink.

15. The LED lamp as claimed in claim 14 further comprising a plurality of reflectors mounted around the envelope and between the support and the first heat sink.

16. The LED lamp as claimed in claim 14 further comprising a drive circuitry received in the support and covered by a plate attached to the top of the support.

17. The LED lamp as claimed in claim 14, wherein the second heat sink has a configuration of a circular tube, a plurality of ridges extending outwardly from an outside wall of the second heat sink, a slot being defined in a corresponding ridge, each of the LED modules being mounted on a corresponding ridge and the slot receiving the evaporating portion of a corresponding heat pipe therein.

* * * * *